US005906156A

United States Patent [19]

Shibuya et al.

[11] Patent Number: 5,906,156

[45] Date of Patent: May 25, 1999

[54] ROTARY PRESS HAVING ADDITIONAL PRINTING APPARATUS

[75] Inventors: Yasuo Shibuya, Kodaira; Ryoji Kaneko, Kawasaki; Akira Motegi, Yokosuka; Kin-ichiro Ohno, Machida, all of Japan

[73] Assignee: Tokyo Kikai Seisakusho, Ltd., Tokyo, Japan

[21] Appl. No.: 08/970,756

[22] Filed: Nov. 14, 1997

[30] Foreign Application Priority Data

Apr. 17, 1997 [JP] Japan ..... 9-114172

[51] Int. Cl.[6] ..... B41F 5/06; B41F 5/16

[52] U.S. Cl. ..... 101/93.12; 101/180

[58] Field of Search ..... 101/181, 178, 101/179, 176, 180, 183, 184, 136, 137, 138, 139, 143, 219, 228, 93.11, 93.12; 347/2, 3, 4, 5–7, 40

[56] References Cited

U.S. PATENT DOCUMENTS 5,533,453 7/1996 Wolfberg et al. ..... 101/176

FOREIGN PATENT DOCUMENTS 62-173257 7/1987 Japan .
62-288039 12/1987 Japan .
63-500714 3/1988 Japan .

OTHER PUBLICATIONS

Printing Engineering Handbook, (Gihodo Shuppan, 1st. Edition), pp. 886–889.
The Newsppaer Technology, 1996–4, No. 158, pp. 130–133.

*Primary Examiner*—J. Reed Fisher
*Attorney, Agent, or Firm*—Armstrong, Westerman, Hattori, McLeland & Naughton

[57] ABSTRACT

There is disclosed a simple and compact additional printing apparatus for a rotary press and a printing unit. The additional printing apparatus includes an ink jet printing device comprising an ink jetting nozzle section and unnecessary ink droplet deflection unit. The ink jetting nozzle section includes a plurality of orifices arranged in a row and ink droplet formation unit. The unnecessary ink droplet deflection unit corresponds to each of the orifices. The ink jet printing device is disposed at a predetermined position in proximity to a paper web pass at which position an additional image can be printed on paper web in alignment with an image printed by the printing cylinder. The apparatus further includes signal output units for outputting a first signal related to the rotational phase of the printing cylinder or the position of a printed image printed through rotation of the printing cylinder, a second signal related to the running speed of paper web, and a third signal related to the amount of travel of the paper web, and control unit for controlling the unnecessary ink droplet deflection unit of the ink jet printing device. The control unit processes image data from a data source and the first through third signals so as to print an image as profiled by the image data at a position specified by the image data in alignment with an image printed by the printing cylinder.

16 Claims, 8 Drawing Sheets

ROTARY PRESS HAVING ADDITIONAL PRINTING APPARATUS

BACKGROUND OF THE INVENTION

1. Field of the Invention

The present invention relates to a rotary press having an additional printing apparatus and to a printing unit having an additional printing apparatus, wherein paper web is run while an image is being printed thereon by a rotating printing cylinder and wherein an additional image such as a spot image is printed thereon in alignment with the image printed by the printing cylinder.

2. Description of the Related Art

A conventional rotary press capable of performing additional printing is described, for example, in "Printing Engineering Handbook," Gihodo Shuppan, Jul. 20, 1987, 1st ed. (3rd impression), p. 887 (FIG. 5.11), p.889 (FIG. 5.13).

A printing unit which can perform additional printing and which constitutes such a conventional rotary press is shown in the above-cited "Printing Engineering Handbook," p. 887 (FIG. 5.12), p.889 (FIG. 5.14), and is disclosed in Japanese Patent Application Laid-Open (kokai) Nos. 62-173257 and 62-288039. Such a printing unit is adapted to print an image in black, for example, on both sides of paper web as well as an additional image in another color on either side of the paper web.

Also, a rotary press capable of performing additional printing is described in "Newspaper Technology 1996-4 No. 158," The Japan Newspaper Publishers and Editors Association, p. 131, right column, lines 8–10, reading "For the first time in the newspaper publishing industry, there is introduced a tower rotary press equipped with a spot-printing device at the top stack to thereby enable 4Hi spot-printing." This rotary press is denoted by "6T" in "Rotary Press Appearance" on page 133 of the publication. This rotary press is adapted to print printing images on both sides of paper web in black and three primary colors, as well as to print an additional image on either side in a special ink, such as a so-called special-color ink and a fluorescent ink which provide a brighter effect for a printed image than the above-mentioned black and three-primary-colors inks and an odorized ink.

In the above-cited "Rotary Press Appearance," printing units denoted by "P2," "P3," and "P4" correspond to the printing unit shown in FIG. 5.14 on page 889 of the aforementioned "Printing Engineering Handbook." "Rotary Press Appearance" shows a rotary press having an additional printing function.

An additional printing apparatus provided in a rotary press as well as in a printing unit is shown in the above-cited "Printing Engineering Handbook" at the upper left portion of FIG. 5.12 on page 887 and at the upper right portion of FIG. 5.14 on page 889.

Further, a conventional ink jet printing device is disclosed, for example, in International Patent Application Laid-Open (Kohyo) No. 63-500714.

As in other printing apparatuses, in the above-described conventional rotary presses having an additional printing apparatus, printing units having an additional printing apparatus, and additional printing apparatuses to be attached to such rotary presses or printing units, a printing plate is attached onto a printing cylinder, and ink is fed alone or together with dampening solution to the attached printing plate to thereby print an image on paper web through transfer of the image directly from the printing plate surface or via the surface of a blanket cylinder.

Accordingly, this kind of printing involves the following problems.

(1) An inking mechanism must be provided in order to feed ink to a printing cylinder and a printing plate attached to the printing cylinder for additional printing. In the case of offset printing, a dampening system must also be provided. Further, in order to align an additional image and an image to which the additional image is added, a registering device must be provided. Thus, an entire printing system requires a relatively large space for installation thereof and involves a number of diversified components, resulting in a large-scaled structure, increased cost of manufacture, and frequent maintenance.

(2) Since printing cylinders and inking mechanisms are provided in one-to-one correspondence, when a printing cylinder is axially divided into a plurality of regions having a predetermined width (e.g. 4 regions), it is quite difficult to print an additional image in a different ink at each of a plurality of locations in the same region or adjacent regions.

(3) A printing plate for additional printing must be prepared, thereby requiring process work and material for a printing plate as well as attachment/detachment of the printing plate.

(4) Maximum printing quantity depends on printing durability of a printing plate.

SUMMARY OF THE INVENTION

The present invention has been accomplished to solve the above-mentioned problems, and an object of the invention is to provide an improved additional printing apparatus for a rotary press and a printing unit, which is simple and compact and which facilitates additional printing.

To achieve the above object, the present invention provides an additional printing apparatus for a rotary press which includes a paper wab supply unit, a printing unit, and a post-printing processing unit and in which a paper web pass is formed from the paper wab supply unit to the post-printing processing unit via the printing cylinder of the printing unit, as well as an additional printing apparatus for a printing unit in which paper web is run while an image is printed onto the paper web by rotation of a printing cylinder. The additional printing apparatus comprises the following components:

(1) an ink jet printing device comprising an ink jetting nozzle section and unnecessary ink droplet deflection means, the ink jetting nozzle section including a plurality of orifices arranged in a row and ink droplet formation means, the unnecessary ink droplet deflection means corresponding to each of the orifices, and the ink jet printing device being disposed at a predetermined position in proximity to a paper web pass at which position an additional image can be printed on paper web in alignment with an image printed by the printing cylinder;

(2) an inking mechanism for feeding ink to the ink jet printing device;

(3) first signal output means for outputting a signal related to the rotational phase of the printing cylinder or the position of a printed image printed through rotation of the printing cylinder;

(4) second signal output means for outputting a signal related to the running speed of paper web;

(5) third signal output means for outputting a signal related to the amount of travel of paper web; and (6) control means for controlling the unnecessary ink droplet deflection means of the ink jet printing device, the control means being connected to a data source which contains image data for printing, as well as to the first signal output means, the second signal output means, and the third signal output means to thereby process image data and signals output from the first, second, and third signal output means so as to print an image as profiled by the image data at a position specified by the image data in a proper amount of ink as well as in alignment with an image printed by a printing cylinder.

The nozzle unit of the ink jet printing device can be arranged in any of the following manners.

First arrangement:

A single nozzle unit is provided along the width direction of paper web over the entire width.

Second arrangement:

The width of paper web is divided into an adequate number of regions, and a plurality of nozzle units corresponding to the regions are provided along the width direction of paper web.

Third arrangement:

A single nozzle unit or a plurality of nozzle units arranged along the width direction of paper web are provided in each of a plurality of rows in the running direction of paper web such that a plurality of nozzle units arranged in the running direction form a group.

Fourth arrangement:

A nozzle unit having a length equal to part of the width of paper web is provided so as to be moved along the width direction of paper web over the entire width and positioned at a desired position by an appropriate moving mechanism.

Fifth arrangement:

A movable nozzle unit or units and a stationary nozzle unit or units are arranged as in the third arrangement.

In the present invention, an additional printing apparatus for use in a rotary press and in a printing unit has a considerably compact and simplified structure as compared to a conventional additional printing apparatus, thereby reducing an installation space for a rotary press having an additional printing apparatus and for a printing unit having an additional printing apparatus.

The present invention allows an additional printing apparatus to be attached to a component other than a printing unit in a rotary press and to be easily attached to a printing unit of a rotary press not equipped with an additional printing apparatus.

Further, since the number of component parts is smaller than a conventional additional printing apparatus, machining and assembly costs are reduced. Also, through employment of a simple mechanism, the frequency of fault occurrence is reduced, and maintenance is easy to perform.

Since registering can be attained by adequately shifting an additional printing image through correction of image data, registering can be performed very quickly, and waste caused by defective registering is reduced.

The printing device of an additional printing apparatus can be provided in regions along the width direction of paper web, or printing devices can be arranged in pairs in the running direction of paper web, both in a very easy manner. Thus, with a printing cylinder being axially divided into a plurality of regions, an additional image can be easily printed in a different ink onto each of images printed through use of the same region or adjacent regions.

Since additional printing is enabled without using a printing cylinder, there is no need for preparing material for a printing cylinder and for making a printing plate. Also, since attachment/detachment of the printing plate is not necessary, work load for additional printing is reduced at a printing shop.

Since no printing plate is used, printing is not influenced by the printing durability of a printing plate, mass printing becomes possible, and image data, once created, can be easily used in a repeated manner.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE INVENTION AND PREFERRED EMBODIMENTS

Figure 1:
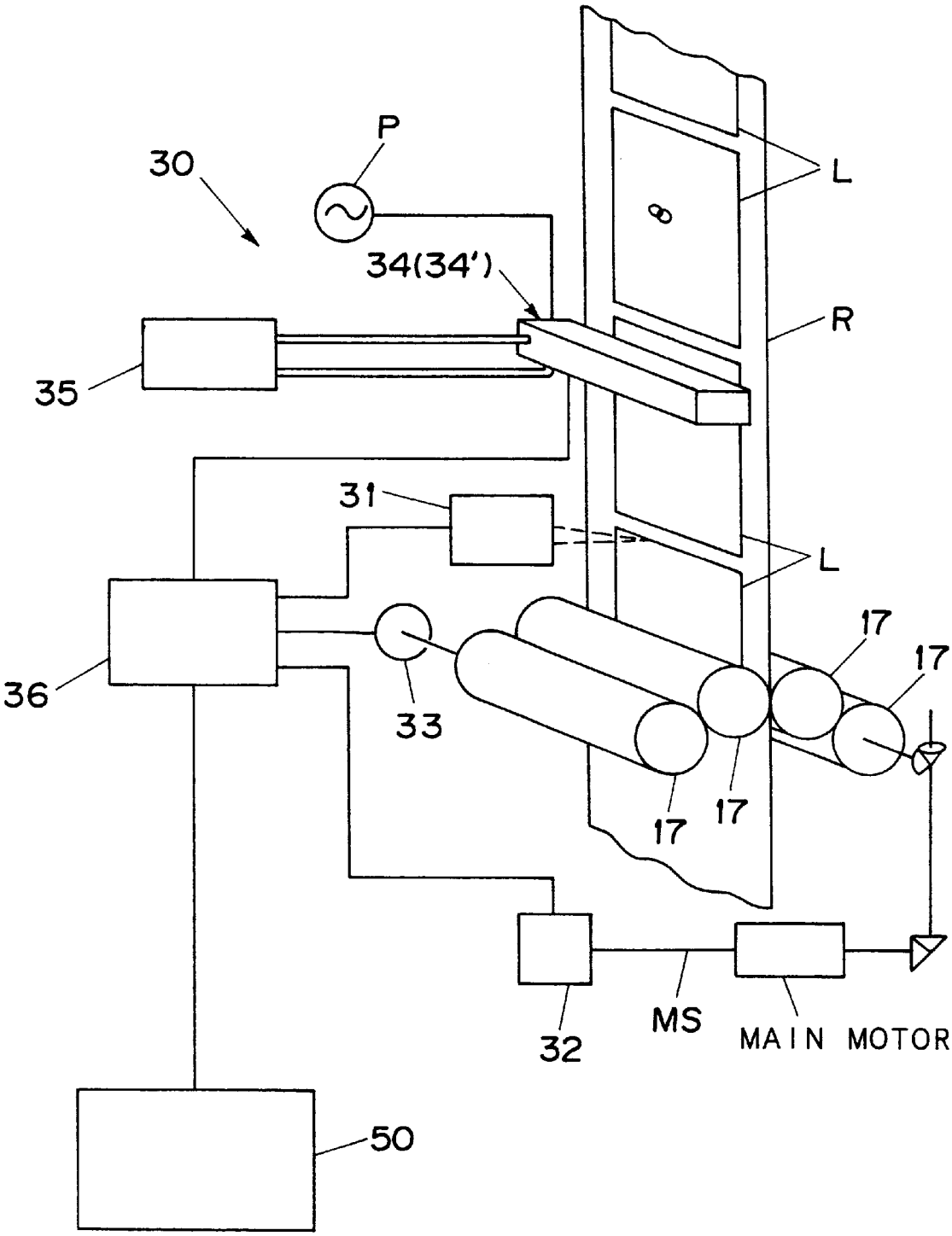
FIG. 1 is a schematic diagram showing the structure of an additional printing apparatus according to an embodiment of the present invention.

In the rotary press according to the present invention, when the rotary press is started, paper web is drawn out from the paper wab supply unit and then reaches the printing unit, where an image is printed on the paper web through transfer of the image from a printing plate attached to a printing cylinder to the paper web while the paper web is passing between printing cylinders.

Subsequently, the thus-printed paper web reaches the ink jet printing device of the additional printing apparatus and undergoes additional printing such as spot printing. After leaving the additional printing apparatus, the printed paper web finally reaches the post-printing processing unit to be processed. The operation of the additional printing apparatus, i.e. additional printing, is performed under control of the control means.

The ink jet printing device performs ink jet printing in the following manner. First, the inking mechanism feeds ink under pressure to the nozzle unit. The thus-fed ink is jetted out in stream from each orifice. This ink stream is formed by the ink droplet formation means into droplets having substantially equal diameters. The thus-formed ink droplets continuously fly toward paper web at equal intervals.

Upon reception of image data regarding an image to be printed from the data source, a signal from the first signal output means, a signal from the second signal output means, and a signal from the third signal output means, the control means processes the received data and signals and, based on the results of processing, selectively activates the unnecessary ink droplet deflection means corresponding to relevant orifices of the ink jet printing device to thereby print an image as profiled by the image data at a position specified by the image data in a proper amount of ink as well as in alignment with an image printed by a printing cylinder.

As a result, the unnecessary ink droplet deflection means corresponding to those orifices through which ink is jetted out toward a non-image area on paper web are activated so as to deflect ink droplets from passes reaching the paper web, thereby preventing ink droplets from reaching the paper web. By contrast, the unnecessary ink droplet deflection means corresponding to those orifices through which ink is jetted toward an image area on the paper web remain inactive, so that ink droplets jetted from these orifices reach the paper web to thereby print an image in accordance with image data at a position specified by the image data on the paper web.

In the arrangement in which the width of paper web is divided into an adequate number of regions, and a plurality of nozzle units corresponding to the regions are provided along the width direction of paper web, not all nozzle units are necessarily operated. That is, the nozzle unit may be selectively operated in accordance with the position of an additional image to be printed. Also, a different ink may be used for each nozzle unit.

In the arrangement in which a single nozzle unit or a plurality of nozzle units arranged along the width direction of paper web are provided in each of a plurality rows in the running direction of paper web such that a plurality nozzle units arranged in the running direction form a group, a different ink may be used for each nozzle unit of the same group.

In the arrangement in which a nozzle unit having a length equal to part of the width of the paper web is provided so as to be moved along the width direction of paper web over the entire width by an appropriate moving mechanism, a nozzle unit can be moved to a desired position along the width direction of paper web to thereby print an additional image on the paper web at the desired position.

Next, embodiments of the present invention will be described.

That is, with reference to the drawings, descriptions will be given of a rotary press having an additional printing apparatus according an embodiment of the present invention, a printing unit having an additional printing apparatus according to another embodiment of the present invention, and an additional printing apparatus to be attached to the rotary press and the printing unit.

A rotary press according to the embodiment of the present invention may be an offset printing rotary press, a letterpress printing rotary press, or the like. The rotary press shown in FIG. 5 is an offset printing rotary press 1.

The offset printing rotary press 1 includes a printing unit which, in turn, includes both-sides monochromatic printing units 11, both-side multicolor printing units 12, single-side monochromatic printing units 13, and a single-side multicolor printing unit 14, paper wab supply units 15 for feeding paper web R to the printing unit, and a post-printing processing unit 16 (such as a folding unit) for processing the printed paper web R. As schematically shown in FIG. 5, the pass of the paper web R is formed by guide members 18 such as guide rollers and unillustrated turning bars and extends from the paper wab supply units 15 to the post-printing processing unit 16 via printing cylinders 17 of the printing units 11, 12, 13, and 14.

Figure 5:
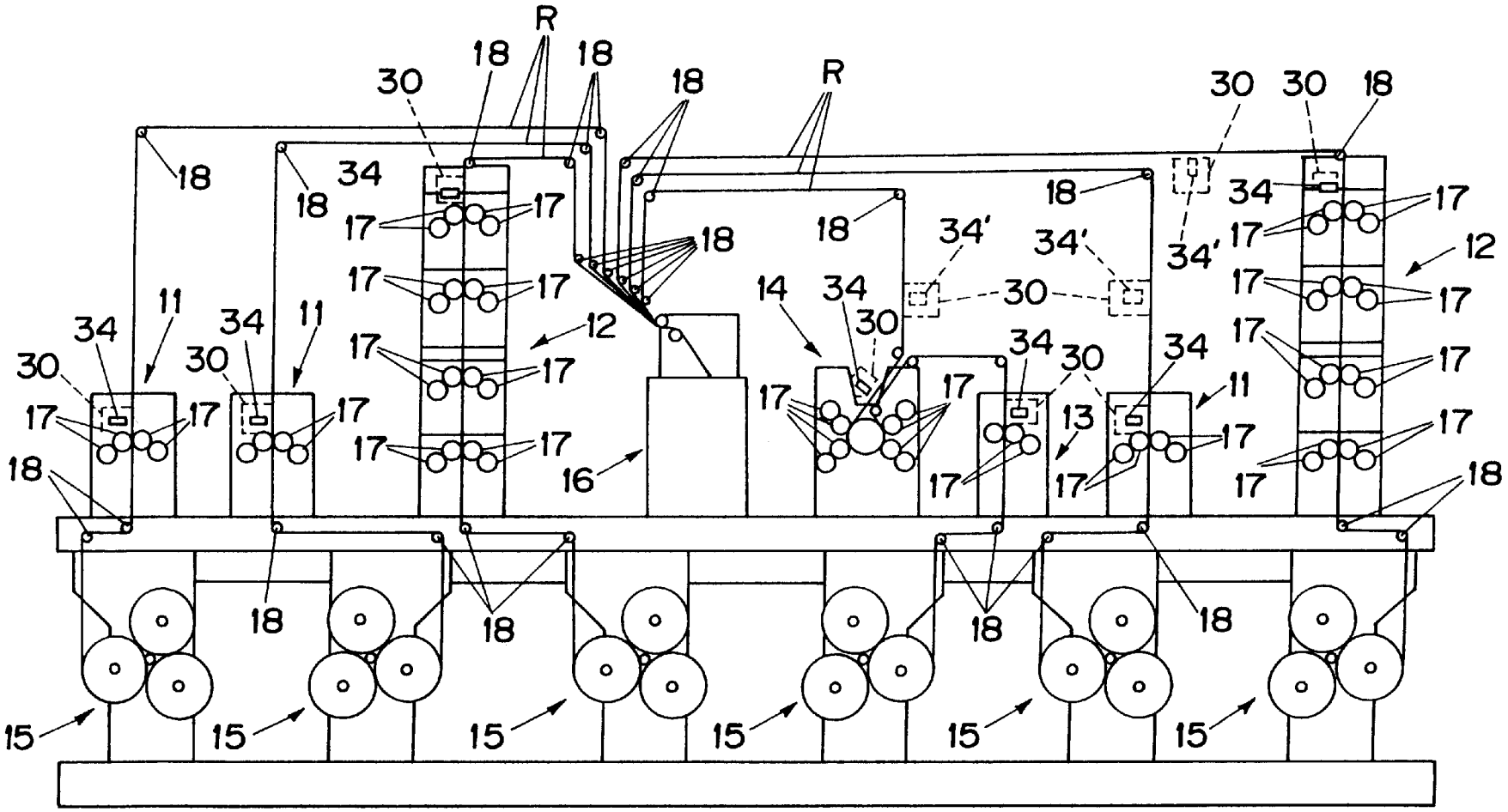
FIG. 5 is a schematic diagram showing the structure of a rotary press having the additional printing device according to the embodiment.

An additional printing apparatus 30 having an ink jet printing device 34 is attached as needed to an appropriate printing unit(s) (attached to all the printing units 11, 12, 13, and 14 in the example of FIG. 5).

Figure 4:
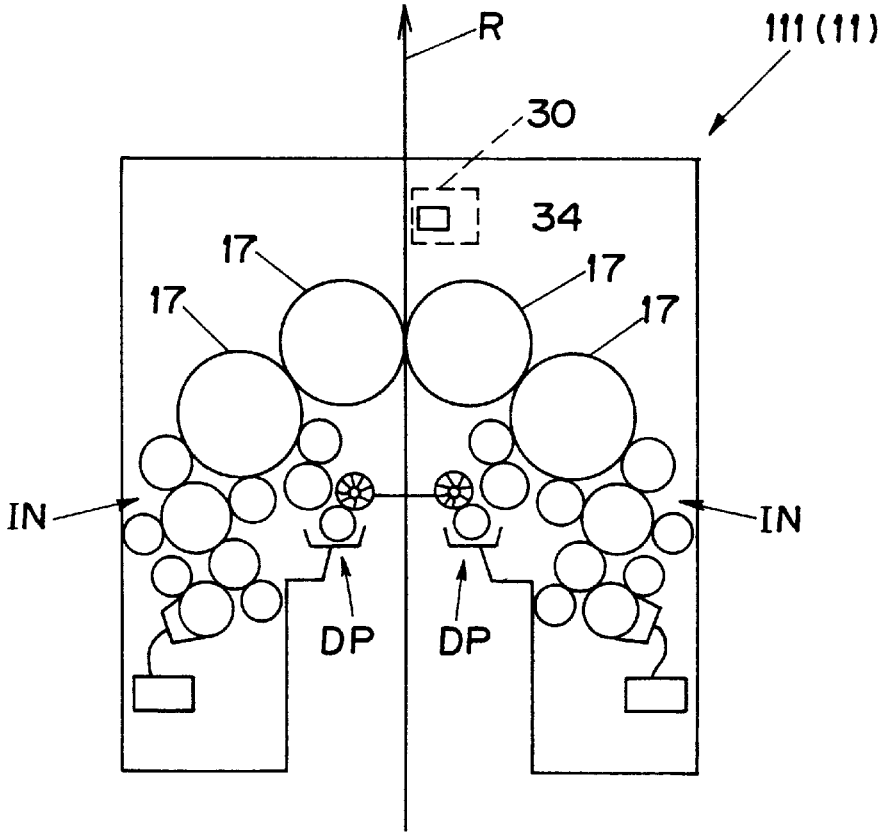
FIG. 4 is a schematic diagram showing the structure of a printing unit having the additional printing device according to the embodiment.

FIG. 4 shows a both-side monochromatic printing unit 111 having the additional printing apparatus 30. The both-side monochromatic printing unit 111 corresponds to the both-side monochromatic printing unit 11 of the offset printing rotary press 1 and includes inking mechanisms IN and dampening systems DP.

In the offset printing rotary press 1, the ink jet printing device 34 of the additional printing apparatus 30 is located downstream of and in the vicinity of the printing cylinders 17 of each of the printing units 11, 12, 13, and 14 (the final printing cylinder 17 in each of the printing units 12 and 14) in order to minimize the effect of elongation of the paper web R on alignment between an image printed by the printing cylinders 17 and an additionally printed image. However, in some cases, like ink jet printing devices 34' represented by a two-dots-and-dash in FIG. 5, an ink jet printing device may be adequately located between each printing unit 11, 12, 13, or 14 and the post-printing processing unit 16 or between each printing unit 11, 12, 13, or 14 and the corresponding paper wab supply unit 15.

That is, the ink jet printing device 34 of the additional printing apparatus 30 may be located where an additional image can be printed in alignment with an image printed by the printing cylinders 17.

Also, the ink jet printing device 34 is provided only on one side of the paper web R in FIGS. 4 and 5, but may be provided on both sides of the paper web R.

The additional printing apparatus 30 will now be described with reference to FIGS. 1, 2, and 3.

The additional printing apparatus 30 is used for, for example, spot-printing an additional image, such as a color-printed headline or the Rising Sun flag (the Japanese flag) printed on newspaper published on a national holiday, in an ink different from that of a regular image. The additional printing apparatus 30 includes the ink jet printing device 34, an inking mechanism 35 for feeding ink to the ink jet printing device 34, first signal output means 31, second signal output means 32, third signal output means 33, and control means 36.

The ink jet printing device 34 includes a nozzle unit 341 for jetting out ink, electrodes 343 for deflecting unnecessary droplets from passes reaching the paper web R, and a driver 345 for operating the electrodes 343 under instructions from the control means 36.

Figure 3:
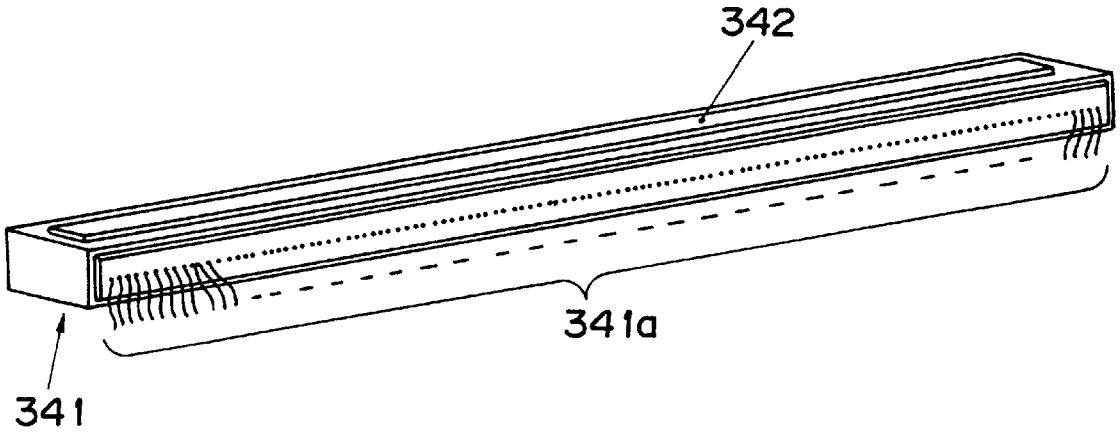
FIG. 3 is a perspective view of a nozzle unit of the ink jet printing device of the additional printing apparatus according to the embodiment.

As shown in FIG. 3, the nozzle unit 341 is composed of an elongated box having a rectangular cross section and defining a communication chamber 341*b* which contains ink. One the front surface of the nozzle unit 341 is formed by an orifice plate in which small-hole orifices 341*a* are formed in a row at predetermined intervals. On the top surface of the nozzle unit 341 adjacent to the orifice plate, there is provided a piezoelectric element 342 for applying high-frequency vibration to ink which is contained in the communication chamber 341*b*. The nozzle unit 341 is arranged in the width direction of the paper web R. As many electrodes 343 as the orifices 341*a* are provided in one-to-one correspondence between the electrodes 343 and the orifices 341*a*. The electrodes 343 are located ahead of the respective orifices 341*a* along passes of jetted ink and are connected to the driver 345 so as to be operated individually. The piezoelectric element 342 and the driver 345 are both connected to a high-frequency power source P.

Figure 2:
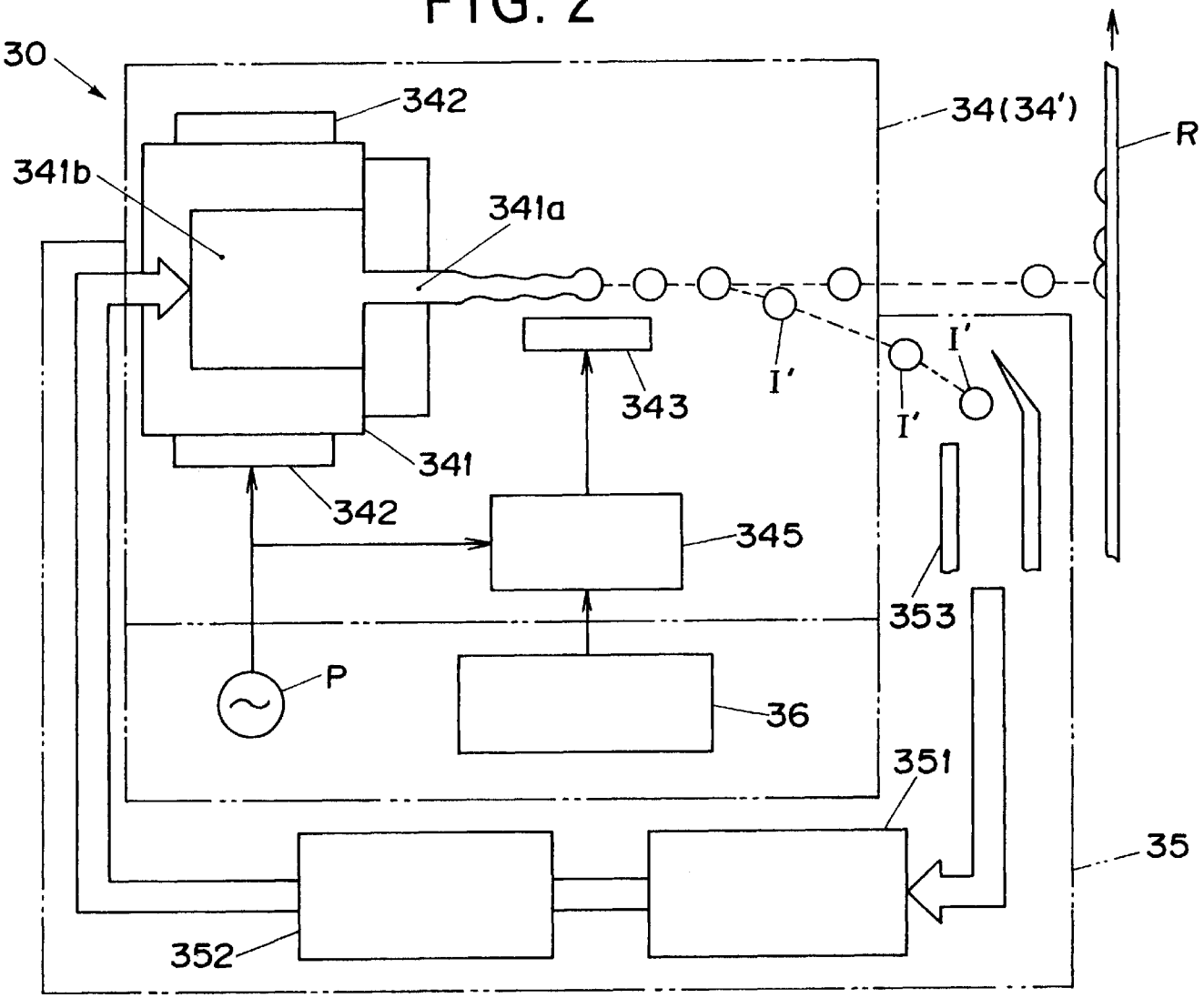
FIG. 2 is a block diagram showing the structure and operation of an ink jet printing device of the additional printing apparatus according to the embodiment.

As shown in FIG. 2, the inking mechanism 35 includes an ink tank 351, ink pressurization means 352 located in an ink feed pass for establishing communication between the ink tank 351 and the communication chamber 341*b* of the nozzle unit 341, and ink collection means 353 located below the passes of unnecessary ink droplets I' which have been deflected by the electrodes 343. The ink collection means 353 communicates with the ink tank 351 via an ink return pass.

The first signal output means 31 detects a predetermined position of an image printed by rotation of the printing cylinders 17 and outputs the detection signal as a first signal to the control means 36 (FIG. 1). An example of such a position is a frame line L which separates printing areas from each other.

The second signal output means 32 outputs a second signal proportional to the running speed of the paper web R to the control means 36. A specific example of the second signal output means 32 is a tachometer generator (FIG. 1) connected to the drive shaft MS of the rotary press and outputting a voltage signal in accordance with the rotational speed of the drive shaft MS.

The third signal output means 33 outputs a third signal proportional to the amount of travel of the paper web R to the control means 36. A specific example of the third signal output means 33 is a rotary encoder (FIG. 1) connected to the printing cylinder 17 and outputting pulses in accordance with rotation of the printing cylinder 17.

The control means 36 is connected to a host CPU or host storage means serving as data source 50 which contains image data representing images to be printed (FIG. 1). The control means 36 determines the position of an additional printing image in the width direction of the running paper web R based on image profile data and device designation data included in image data received from the data source 50.

The operation of the rotary press having an additional printing apparatus and the printing unit having an additional printing apparatus will now be described.

When the offset printing rotary press 1 shown in FIG. 5 is started, the paper web R is drawn out from the paper wab supply units 15 and then reaches the printing units 11, 12, 13, and 14, in each of which an image is printed by a known action on the paper web R through transfer of the image from a printing plate attached to the printing cylinder 17 to the paper web R while the paper web R is passing between the printing cylinders 17.

Subsequently, the thus-printed paper web R reaches the ink jet printing device 31 of the additional printing apparatus 30 and undergoes additional printing such as spot printing.

The thus-additionally-printed paper web R finally reaches the post-printing post-printing processing unit 16 and is processed therein. For example, when the post-printing processing unit 16 is a folding unit, the paper web R is cut into sheets of a predetermined size, which are then folded and ejected.

The operation of the additional printing apparatus 30, i.e. additional printing, is performed under control of the control means 36. In the additional printing apparatus 30 having a plurality of the ink jet printing devices 34, the control means 36 performs control so as to operate the ink jet printing device 34 designated by device designation data.

The ink jet printing device 34 performs ink jet printing in the following manner. First, ink from the ink tank 351 is pressurized by the ink pressurization means 352 and is then fed under pressure into the communication chamber 341*b* of the nozzle unit 341. The thus-fed ink is jetted out in stream from all the orifices 341*a*. Each ink stream is formed into droplets having substantially equal diameters through application of high-frequency vibration induced by the piezoelectric element 342, which is energized by the high-frequency power source P. The thus-formed ink droplets continuously fly toward the paper web R at equal intervals.

The electrodes 343 corresponding to those orifices 341*a* through which ink is jetted out toward a non-image area on the paper web R are activated by the driver 345 to thereby charge ink droplets with electricity having an appropriate potential. As a result, the thus-charged ink droplets I' are deflected so as not to reach the paper web R. By contrast, the electrodes 343 corresponding to those orifices 341*a* through which ink is jetted out toward an image area on the paper web R are not activated by the driver 345 in principle so as to form an image on the paper web R.

That is, only ink droplets that have not been charged by the electrodes 343 reach the running paper web R to thereby form an image on the paper web R through adhesion thereto. On the other hand, the charged, deflected ink droplets I' are received by the ink collection means 353, and the thus-collected ink is returned to the ink tank 351 via the ink return pass.

In actuality, even the electrodes 343 corresponding to those orifices 341*a* through which ink is jetted out toward an image area on the paper web R may be operated by the driver 345 at a variable frequency which is controlled in order to adjust the amount of ink used for forming an image, thereby adjusting the density of an image, for example.

The control means 36, which controls the operation of the driver 345 for the electrodes 343 as described above, receives image data from the data source 50. Based on the received image data, the control means 36 causes the additional printing apparatus 30 to perform printing. The image data includes position designation data, image profile data, and device designation data. The position designation data designates the position of an image to be printed by the additional printing apparatus 30 with respect to the position of an image to be printed by the printing cylinders 17. The image profile data determines the profile of an image to be printed by the additional printing apparatus 30. The device designation data designates one of the ink jet printing devices 34 as needed.

Also, the control means 36 receives the first output signal from the first signal output means 31, the second output signal from the second signal output means 32, and the third output signal from the third signal output means 33. The control means 36 determines an image position designated by the position designation data based on the received first and second output signals and calculates the running speed of the paper web R based on the received second output signal.

Then, the control means 36 inputs control signals for the individual electrodes 343 into the driver 345 in order to print an image as profiled by the image profile data on the running paper web R at a position designated by the position designation data in a proper amount of ink corresponding to the running speed of the paper web R.

In the additional printing apparatus 30 shown in FIG. 1, the first signal output means 31, the second signal output means 32, and the third signal output means 33 are provided separately from each other. However, the third signal output means 33, which is a rotary encoder to output pulses synchronously with rotation of the printing cylinders 17, may be utilized as the second signal output means. Alternatively, this rotary encoder may have an origin signal output function to thereby serve as the first signal output means, the second signal output means, and the third signal output means.

In the case where the rotary encoder having the origin signal output function is also used as the first signal output means, an origin signal which is output when the printing cylinder 17 is at a predetermined rotational phase is used as the first output signal. That is, this origin signal is considered to indicate a point of time when a predetermined portion of an image is printed on the paper web R by the printing cylinder 17.

Therefore, the origin signal output from the rotary encoder having the origin signal output function can be regarded as a signal indicating that the first signal output means 31 detects the predetermined portion at the printing position of the printing cylinder 17. This detection utilizes the fact that the printed predetermined portion travels a constant amount until it reaches the ink jet printing device, i.e. the pass of the paper web R extending from the printing position of the printing cylinder 17 to the printing position of the ink jet printing device has a constant distance.

In the case where the rotary encoder having the origin signal output function or the rotary encoder not having the origin signal output function is also used as the second signal output means, the running speed of the paper web R is calculated by utilizing the fact that the number of pulses output from the rotary encoder within a unit time is proportional to the operating speed of the rotary press, i.e. the running speed of the paper web R.

The nozzle unit(s) 341 of the ink jet printing device 34 is arranged in any of the following manners.

Figure 6A:
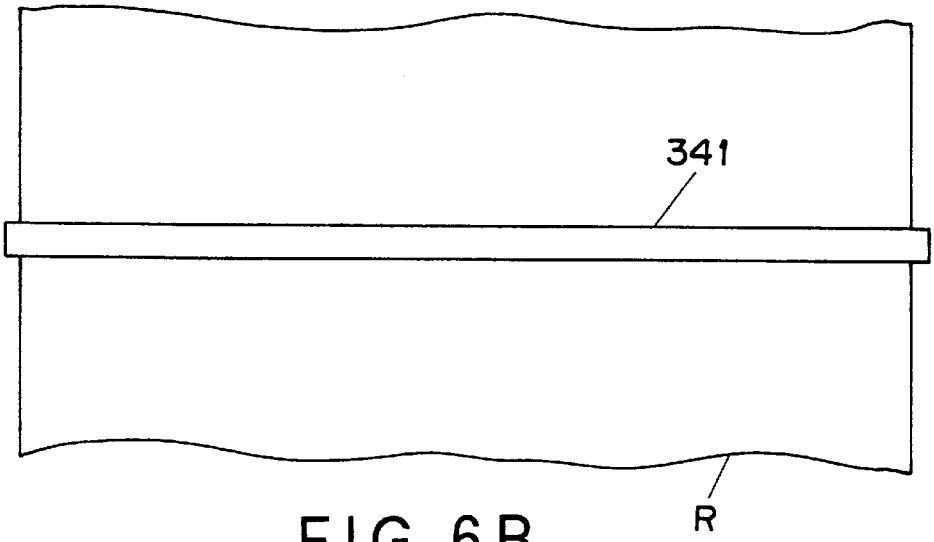
FIGS. 6A–6C are diagrams each showing an exemplary arrangement of nozzle units of the ink jet printing device according to the embodiment.

First arrangement (FIG. 6A):

The single nozzle unit 341 is provided along the width direction of the paper web R over the entire width.

Figure 6B:
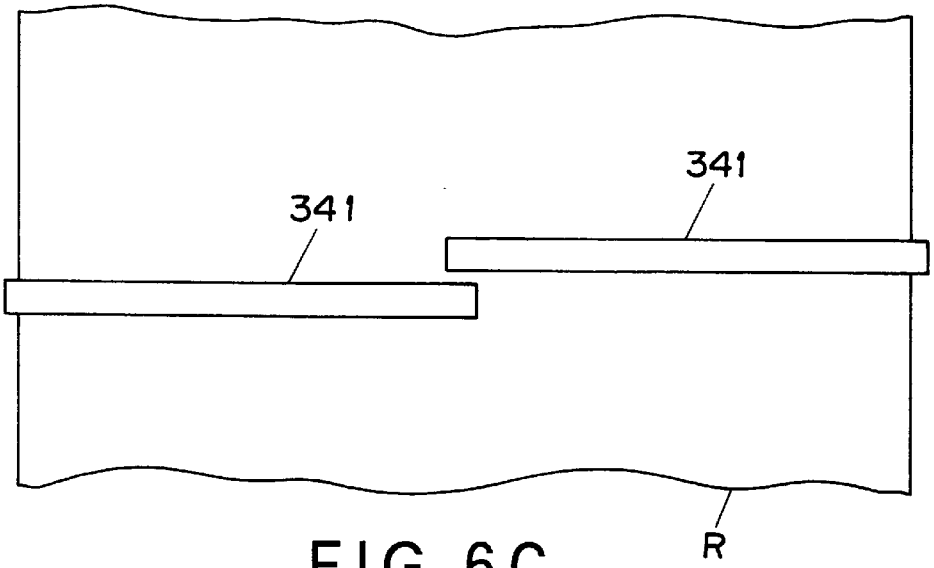
Figure 6C:
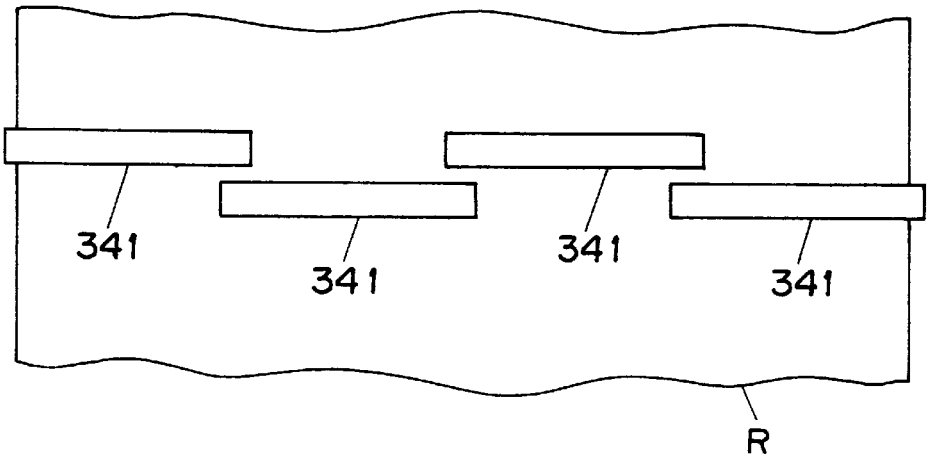

Second arrangement (FIGS. 6B and 6C):

The width of the paper web R is divided into an adequate number of regions (two or four regions in the illustrated examples), and a plurality of the nozzle units 341 corresponding to the regions are provided along the width direction of the paper web R. Specifically, the nozzle units 341 are arranged in a staggered manner with adjacent end portions thereof overlapping each other. Like the first arrangement, orifices are arranged at equal intervals in the width direction of the paper web R.

In contrast to the first arrangement wherein the nozzle unit 341 is always operated over the entire width of the paper web R, any of the nozzle units 341 may be selectively operated in accordance with the printing position of an additional image. Also, printing in a different ink is possible for each nozzle unit 341.

Figure 7A:
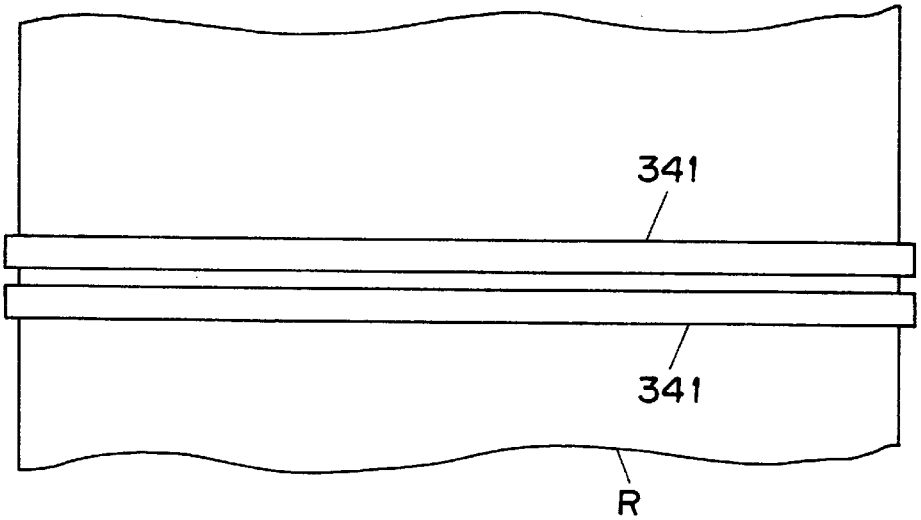
FIGS. 7A–7C are diagrams each showing an exemplary arrangement of nozzle units of the ink jet printing device according to the embodiment.
Figure 7B:
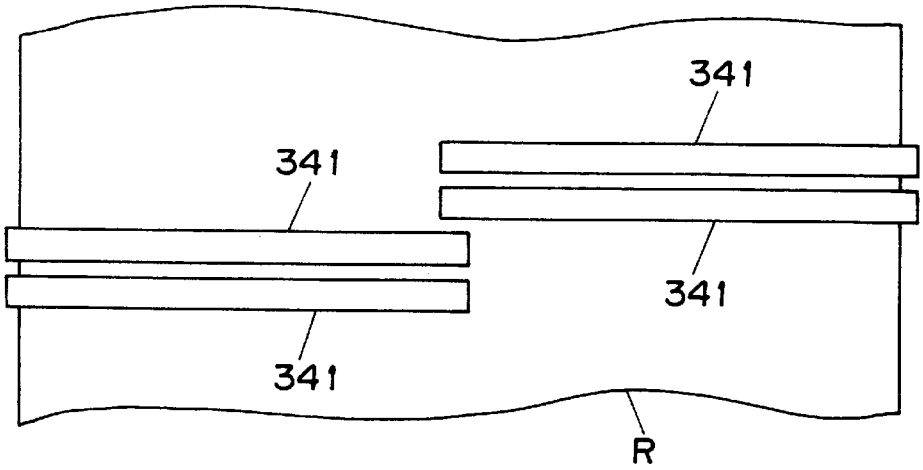
Figure 7C:
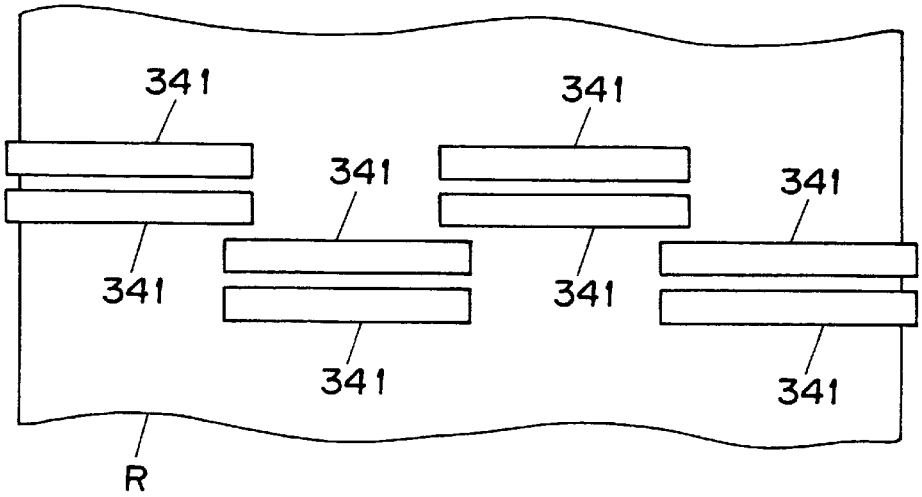

Third arrangement (FIGS. 7A–7C):

Single nozzle units 341 or a plurality of nozzle units 341 arranged along the width direction of paper web are provided in pairs in the running direction of the paper web R. In the illustrated examples, the nozzle units 341 used in the first and second arrangements are provided in pairs in the running direction of the paper web R.

Printing in a different ink is possible for each of the paired nozzle units 341.

Fourth arrangement (FIGS. 8A–8C and FIG. 9A):

The nozzle unit 341 having a length equal to part (e.g. half or one-fourth) of the width of the paper web R is provided so as to be moved along the width direction of the paper web R over the entire width by an appropriate moving mechanism. In the illustrated examples, a feed screw 38 extending over the entire width of the paper web R is rotatably attached to a device frame. One end of the feed screw 38 is connected directly or via gears to an appropriate drive means such as a pulse motor 39. The nozzle unit 341 is attached to a female-screw member 37 which, in turn, is attached to the feed screw 38 through screw engagement.

The movement of the nozzle unit 341 may be controlled through the use of the device designation data contained in the image data supplied by the data source 50 or through a manual operation of outputting a signal which designates a destination of the nozzle unit 341. The length of the nozzle units 341 shown in FIGS. 8A and 8B corresponds to that of the nozzle units 341 shown in FIGS. 6B and 6C. The nozzle units 341 shown in FIG. 8C and FIG. 9A correspond to those shown in FIGS. 7B and 7C.

By moving the nozzle unit 341 to a desired position, an additional image can be printed on the paper web R at a desired position in the width direction of the paper web R. Particularly, for the nozzle units 341 shown in FIG. 8C and FIG. 9A, printing in a different ink is possible for each of the paired nozzle units 341 as in the third arrangement.

Figure 8A:
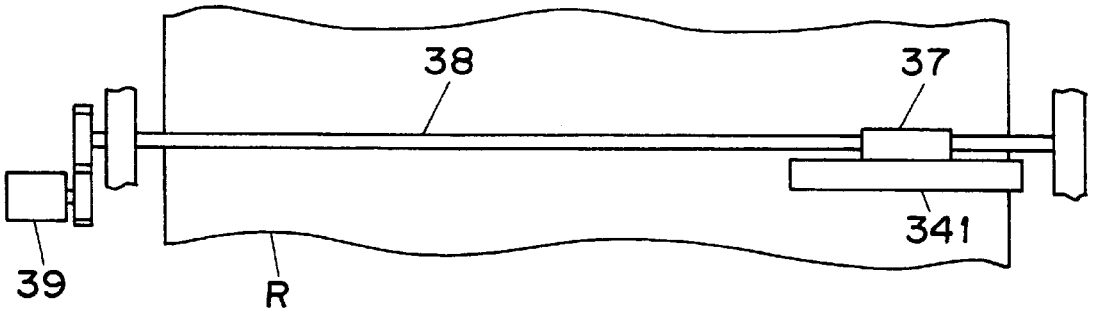
FIGS. 8A–8C are diagrams each showing an exemplary arrangement of nozzle units of the ink jet printing device according to the embodiment.
Figure 8B:
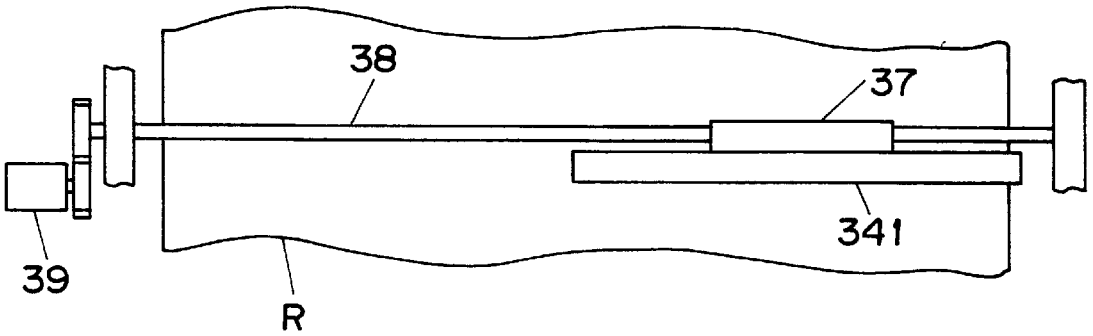
Figure 8C:
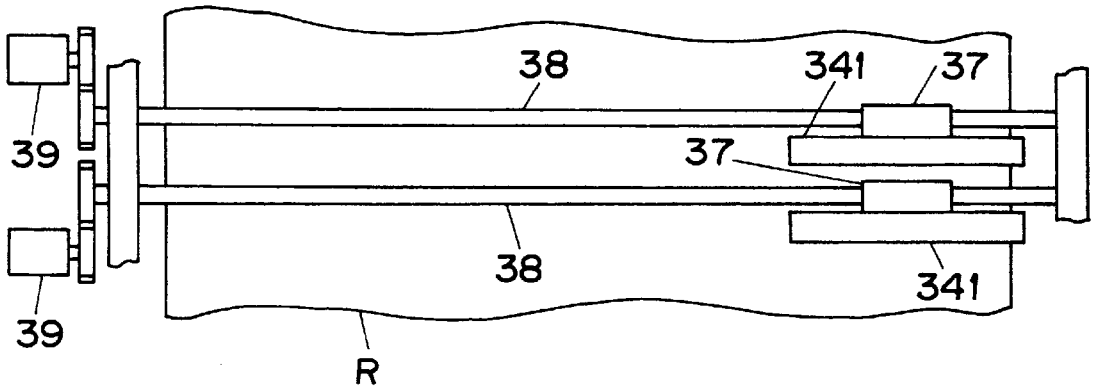
Figure 9A:
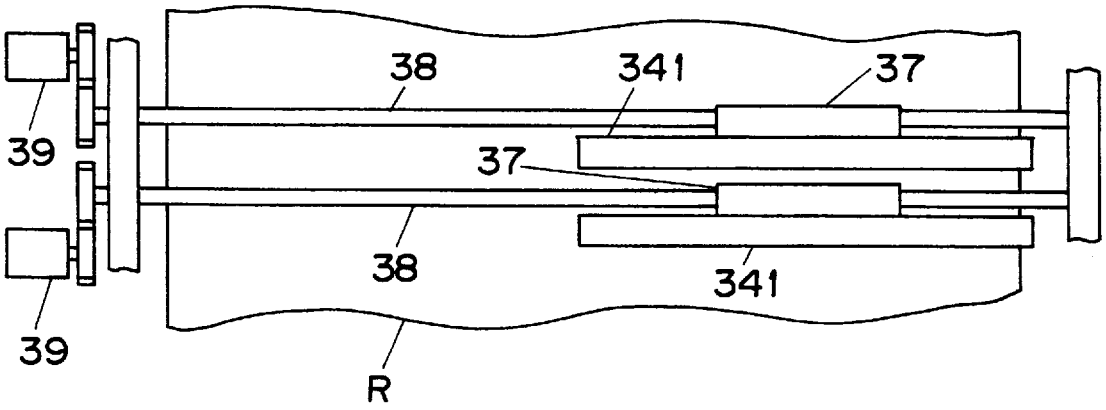
FIGS. 9A–9C are diagrams each showing an exemplary arrangement of nozzle units of the ink jet printing device according to the embodiment.
Figure 9B:
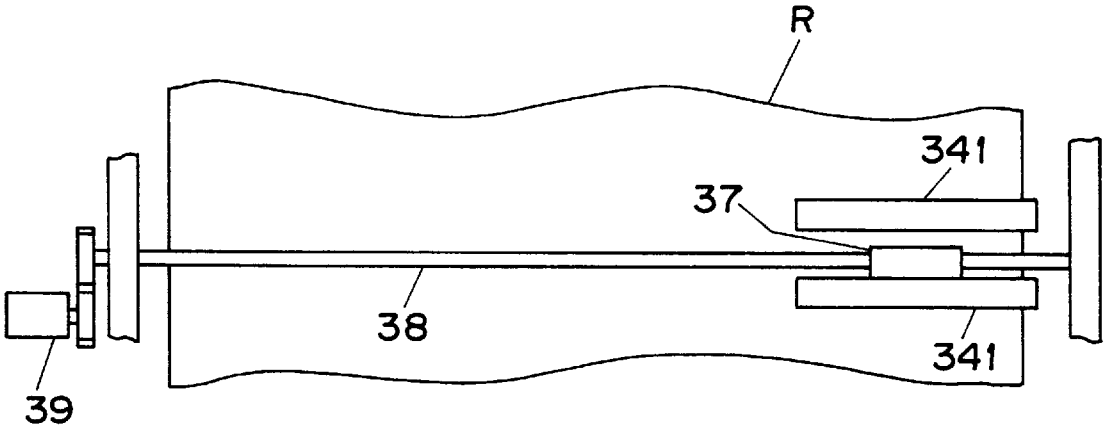
Figure 9C:
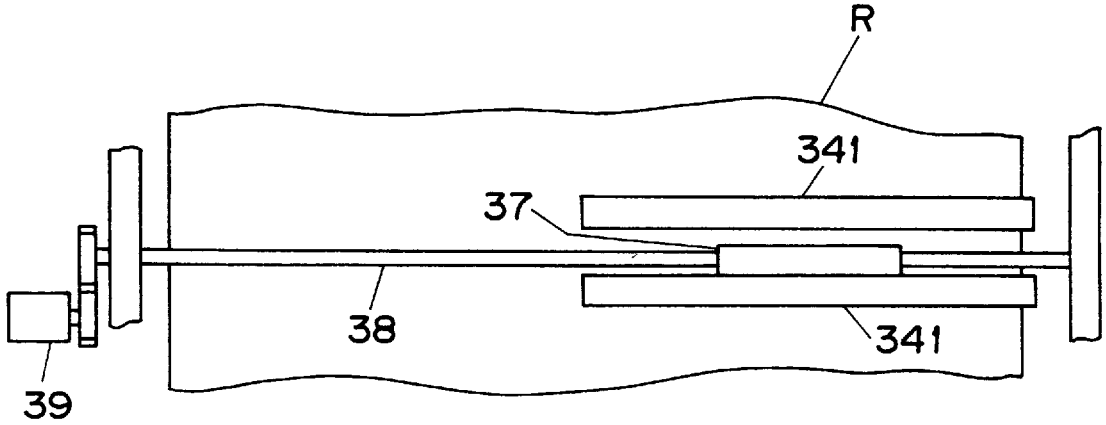

Fifth arrangement (FIGS. 9B and 9C):

As in the arrangements shown in FIGS. 8C and 9A, two paired nozzle units 341 are arranged in the running direction of the paper web R. However, one of the nozzle units 341 is movable in the widthwise direction and the other of the nozzle units 341 is stationary.

The stationary nozzle unit 341 is used for printing at a regularly or frequently used position, while the movable nozzle unit 341 is used in a manner similar to that in the case of the arrangements shown in FIGS. 8C and 9A.

In the case where the nozzle units 341 are arranged in a plurality of rows in the running direction of the paper web R (e.g. FIGS. 7A–7C, 8C, and 9A–9C), the nozzle units 341 may have the same length as illustrated or different lengths.

Obviously, numerous modifications and variations of the present invention are possible in light of the above teachings. It is therefore to be understood that within the scope of the appended claims, the present invention may be practiced otherwise than as specifically described herein.

What is claimed is:

1. A rotary press which includes an additional printing apparatus as well as a paper wab supply unit, a printing unit, and a post-printing processing unit and in which a paper web pass is formed from the paper wab supply unit to the post-printing processing unit via a printing cylinder of the printing unit, said additional printing apparatus comprising:

an ink jet printing device comprising an ink jetting nozzle section and unnecessary ink droplet deflection means, said ink jetting nozzle section including a plurality of orifices arranged in a row and ink droplet formation means, said unnecessary ink droplet deflection means corresponding to each of said orifices, and said ink jet printing device being disposed at a predetermined position in proximity to a paper web pass at which position an additional image can be printed on paper web in alignment with an image printed by the printing cylinder;

an inking mechanism for feeding ink to the ink jet printing device;

first signal output means for outputting a signal related to the rotational phase of the printing cylinder or the position of a printed image printed through rotation of the printing cylinder;

second signal output means for outputting a signal related to the running speed of the paper web;

third signal output means for outputting a signal related to the amount of travel of the paper web; and control means for controlling the unnecessary ink droplet deflection means of the ink jet printing device, the control means being connected to a data source which contains image data for printing, as well as to the first signal output means, the second signal output means, and the third signal output means to thereby process image data and signals output from the first, second, and third signal output means so as to print an image as profiled by the image data at a position specified by the image data in a proper amount of ink as well as in alignment with an image printed by a printing cylinder.

2. A rotary press with an additional printing apparatus according to claim 1, wherein the ink jet printing device is movable along the width direction of the paper web and is positioned at a desired position selected from a plurality of predetermined positions.

3. A rotary press with an additional printing apparatus according to claim 1, wherein the ink jet printing device has a length corresponding to the width of the paper web.

4. A rotary press with an additional printing apparatus according to claim 1, wherein a plurality of the ink jet printing devices are disposed in order to cover the entire width of the paper web.

5. A rotary press with an additional printing apparatus according to claim 1, wherein the ink jet printing device is provided in each of a plurality of rows defined in the running direction of the paper web.

6. A rotary press with an additional printing apparatus according to claim 2, wherein the ink jet printing device is provided in each of a plurality of rows defined in the running direction of the paper web.

7. A rotary press with an additional printing apparatus according to claim 3, wherein the ink jet printing device is provided in each of a plurality of rows defined in the running direction of the paper web.

8. A rotary press with an additional printing apparatus according to claim 4, wherein the ink jet printing device is provided in each of a plurality of rows defined in the running direction of the paper web.

9. A printing unit in which paper web is run while an image is printed onto the paper web by rotation of a printing cylinder and to which an additional printing apparatus is added, said additional printing apparatus comprising:

an ink jet printing device comprising an ink jetting nozzle section and unnecessary ink droplet deflection means, said ink jetting nozzle section including a plurality of orifices arranged in a row and ink droplet formation means, said unnecessary ink droplet deflection means corresponding to each of said orifices, and said ink jet printing device being disposed at a predetermined position in proximity to a paper web pass at which position an additional image can be printed on paper web in alignment with an image printed by the printing cylinder;

an inking mechanism for feeding ink to the ink jet printing device;

first signal output means for outputting a signal related to the rotational phase of the printing cylinder or the position of a printed image printed through rotation of the printing cylinder;

second signal output means for outputting a signal related to the running speed of the paper web;

third signal output means for outputting a signal related to the amount of travel of the paper web; and control means for controlling the unnecessary ink droplet deflection means of the ink jet printing device, the control means being connected to a data source which contains image data for printing, as well as to the first signal output means, the second signal output means, and the third signal output means to thereby process image data and signals output from the first, second, and third signal output means so as to print an image as profiled by the image data at a position specified by the image data in a proper amount of ink as well as in alignment with an image printed by a printing cylinder.

10. A printing unit with an additional printing apparatus according to claim 9, wherein the ink jet printing device is movable along the width direction of the paper web and is positioned at a desired position selected from a plurality of predetermined positions.

11. A printing unit with an additional printing apparatus according to claim 9, wherein the ink jet printing device has a length corresponding to the width of the paper web.

12. A printing unit with an additional printing apparatus according to claim 9, wherein a plurality of the ink jet printing devices are disposed in order to cover the entire width of the paper web.

13. A printing unit with an additional printing apparatus according to claim 9, wherein the ink jet printing device is provided in each of a plurality of rows defined in the running direction of the paper web.

14. A printing unit with an additional printing apparatus according to claim 10, wherein the ink jet printing device is provided in each of a plurality of rows defined in the running direction of the paper web.

15. A printing unit with an additional printing apparatus according to claim 11, wherein the ink jet printing device is provided in each of a plurality of rows defined in the running direction of the paper web.

16. A printing unit with an additional printing apparatus according to claim 12, wherein the ink jet printing device is provided in each of a plurality of rows defined in the running direction of the paper web.

* * * * *